US006151853A

United States Patent [19]

Fukunaga

[11] Patent Number: 6,151,853

[45] Date of Patent: Nov. 28, 2000

[54] OUTDOOR FLOOR CONSTRUCTION

[76] Inventor: Hiroshi Fukunaga, 4-5 Akasaka 2-chome Chuo-Ku, Fukuoka City, Japan

[21] Appl. No.: 09/283,544

[22] Filed: Apr. 1, 1999

[30] Foreign Application Priority Data

Apr. 1, 1998 [JP] Japan ..... 10-106941

[51] Int. Cl.[7] ..... E04B 1/00

[52] U.S. Cl. ..... 52/264; 52/582.1; 52/282.2; 52/284; 52/286

[58] Field of Search ..... 52/264, 660, 79.6, 52/263, 282.2, 284, 286, 126.6, 126.7, 585.1, 582.1

[56] References Cited

U.S. PATENT DOCUMENTS

| | | | |
|---|---|---|---|
| 5,389,737 | 2/1995 | Kobayashi et al. | 174/48 |
| 5,404,683 | 4/1995 | Hammonds et al. | 52/263 |
| 5,479,745 | 1/1996 | Kawai et al. | 52/126.2 |
| 5,771,646 | 6/1998 | DeSouza | 52/263 |
| 5,791,096 | 8/1998 | Chen | 52/126.6 |
| 5,862,643 | 1/1999 | Schilham | 52/745.19 |
| 5,904,015 | 5/1999 | Chen | 52/220.2 |

*Primary Examiner*—Christopher T. Kent
*Assistant Examiner*—Jennifer I. Thissell
*Attorney, Agent, or Firm*—Morrison Law Firm

[57] ABSTRACT

The present invention provides an outdoor floor construction, having at least first and second floor surface units. The first and second floor surface units are installable adjacent each other and capable of assembly with edges abutting each other. There is at least a first hole in first floor surface unit and a second hole in the second floor surface unit. In addition, there is at least one joint member having means for supporting the floor surface units and which is aligned below the first hole and said second hole. The joint member has at least a first and second latching piece. A first latching piece fits into the first hole and the second latching piece fits into the second hole thereby retaining the first and second floor surface units with respect to one another. Wall units may also be installed along the outer edge of the floor using similar construction.

5 Claims, 16 Drawing Sheets

OUTDOOR FLOOR CONSTRUCTION

BACKGROUND OF THE INVENTION

The present invention relates to an outdoor floor construction such as that used for open verandahs and decks. Outdoor floor construction of verandahs and decks built on houses are known in the prior art. The outdoor floor construction of the prior art is connected to large-size windows through which people can go inside and outside. In order to build this type of outdoor floor construction, piers are arranged in a standing condition on the foundation. Sleepers are anchored onto the piers. Floor joists are further anchored to the sleepers. Floor material is then placed on top of the floor joists.

However, when built in this manner, sleepers and floor joists which are large and lengthy, need to be built in addition to the placement of the floor material. Construction is difficult. Furthermore, the area of the floor (the area where the floor material will be placed) is roughly the same as the area where the floor joists are present, and as a result, once it has been built, it is extremely difficult to change the area of the floor.

OBJECT AND SUMMARY OF THE INVENTION

The object of the present invention is to provide an outdoor floor construction in which the construction and alterations of the area can be achieved easily.

Briefly stated, the present invention provides an outdoor floor construction, having at least a first and second floor surface units. The first and second floor surface units may be installed adjacent each to other and are capable of assembly with edges abutting each other. There is at least a first hole in the first floor surface unit and a second hole in the second floor surface unit. In addition, there is at least one joint member having means for supporting the floor surface units which is aligned below the first hole second holes. The joint member has at least a first and second latching piece. A first latching piece fits into the first hole and a second latching piece fits into the second hole thereby retaining the first and second floor surface units with respect to one another.

The present invention provides an outdoor floor construction in which construction and alteration of the floor area are easy. Use of sleepers and floor joists is not necessary to provide adequate support for the floor.

The above, and other objects, features and advantages of the present invention will become apparent from the following description read in conjunction with the accompanying drawings, in which like reference numerals designate the same elements.

DETAILED DESCRIPTION OF THE EMBODIMENTS

Figure 1:
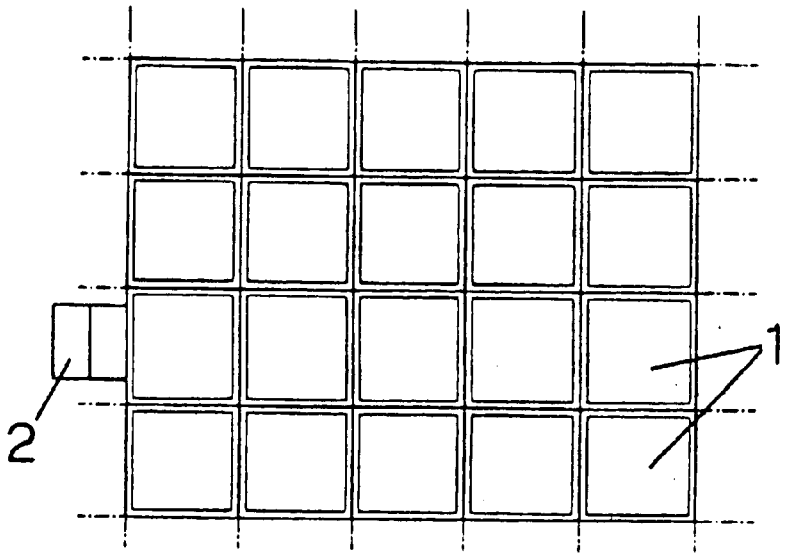
FIG. 1 is a floor diagram of an outdoor floor construction of an embodiment of the present invention.

According to an embodiment of the invention, an outdoor floor construction is provided, having at least a first and second floor surface units. The first and second floor surface units may be installed adjacent each to other and are capable of assembly with edges abutting each other. There is at least a first hole in a first floor surface unit and a second hole in the second floor surface unit. In addition, there is at least one joint member having means for supporting the floor surface units which is aligned below the first hole and second holes. The joint member has at least a first and second latching piece. A first latching piece fits into the first hole and a second latching piece fits into the second hole thereby retaining the first and second floor surface units with respect to one another.

According to another embodiment of the present invention, a floor construction is provided which further comprises at least a third and fourth floor surface unit. The first, second, third and fourth floor surface units are capable of being installed so that they share a common corner. There is a first hole in the third floor surface unit and a second hole in the fourth floor surface unit. A joint member is aligned below the floor surface units and has at least two latching pieces. The latching pieces fit into the first and second holes, thereby retaining the first, second, third and fourth floor surface units with respect to one another.

With this construction, there is no need to expend extra work and materials in constructing sleepers or joists. Thus, construction becomes that much easier.

Furthermore, after it is built, the placement of the floor surface unit group can be changed or increased or decreased. Since these changes are not restricted by sleepers or joists, they can be conducted easily.

According to another embodiment of the present invention a floor construction is provided where the floor surface units include holes along the edge of the floor surface unit and through holes in the interior of the floor surface unit. With this construction, rain and the like can drip downwards from almost the entire surface of the floor surface unit. The water drainage of the outdoor construction is improved, and the life of the outdoor floor construction is extended.

According to another embodiment of the present invention a floor construction is provided where the floor surface units include holes along the edge and having board material placed along the interior of the floor surface unit. With this construction, the outdoor floor is made as flat as possible. Chair legs or heels of women's shoes are less likely to become trapped.

According to another embodiment of the present invention a floor construction is provided which includes an adjustment means permitting vertical adjustment of the floor surface units.

According to another embodiment of the present invention a floor construction is provided which includes a low wall. The low wall is formed from at least one low wall unit which has holes along four edges and a means for attachment to other wall units and to an outer edge of the floor surface unit. The low wall is arranged in a vertical position along the outer edge of the floor construction.

According to another embodiment of the present invention a floor construction is provided where the low wall unit has at least first and second teeth projecting downward from its bottom surface. The teeth are fixedly secured into holes of floor surface units using wedges.

Figure 2:
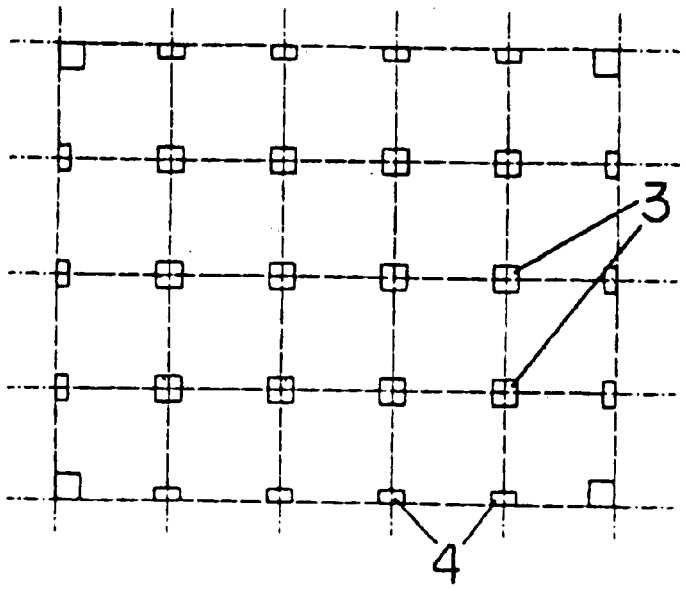
FIG. 2 is a joint diagram of the present invention.
Figure 3:
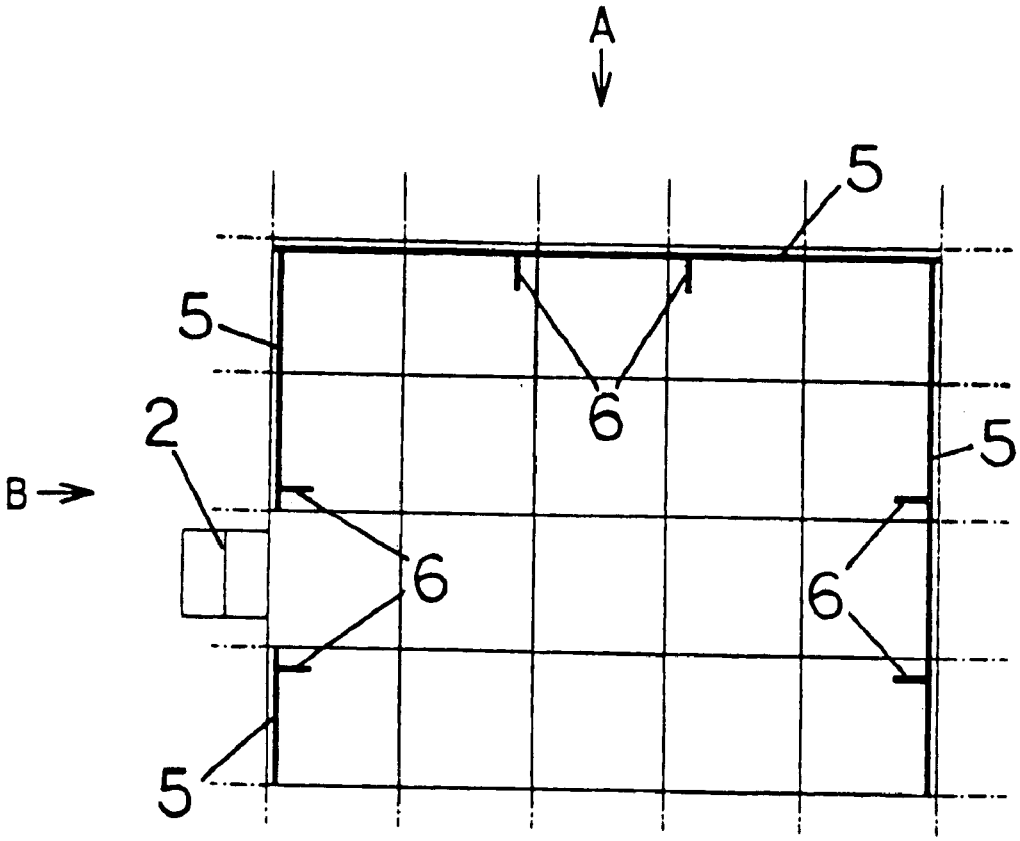
FIG. 3 is a wall diagram of the present invention.

Next, referring to the drawings, the embodiments of the present invention will be described. Referring to FIG. 1, there is a floor diagram of the outdoor floor construction of one embodiment of the present invention. Referring to FIG. 2, there is shown a diagram of a joint of the present invention. Referring to FIG. 3, there is shown a diagram of a low wall of the present invention.

Referring to FIGS. 1–3, the outdoor floor construction of one embodiment will be described. Referring to FIG. 1, at the floor level, square floor surface units 1 are placed horizontally in a tiled manner. Furthermore, the side surfaces of floor surface units 1 which are adjacent to each other are spaced closely together. Stairs 2 are installed for the exit and entry of people.

Figure 6:
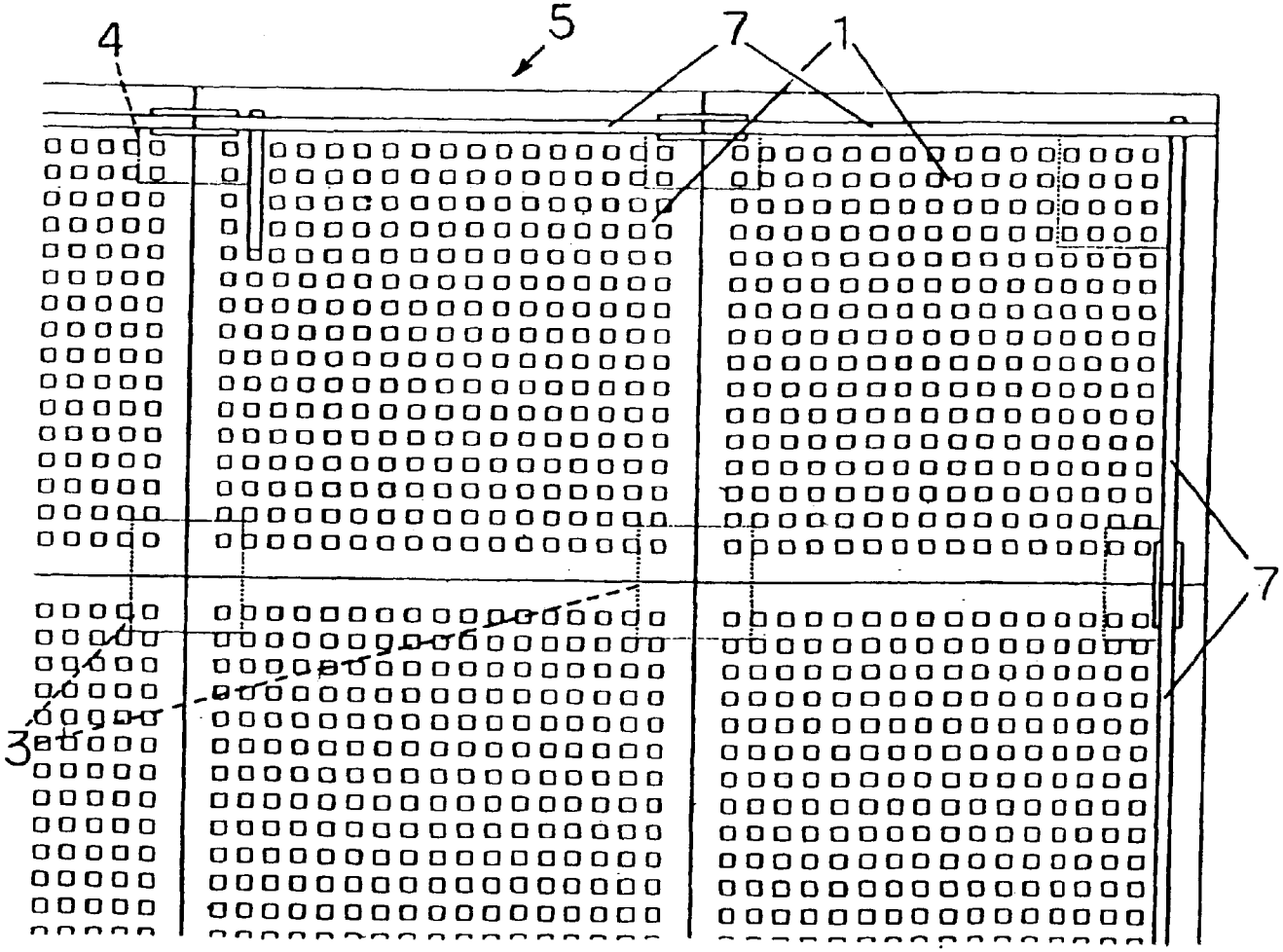
FIG. 6 is an expanded view of a part of FIG. 1.

Next, referring to FIG. 1 and FIG. 6, joints 3,4 are placed at a level below the surface of floor surface units 1, so that they contact the four corners of each floor surface unit 1 from underneath. As will be described later, if there is only earth underneath joints 3, 4, they are placed on top of the soil. If a surface of concrete is formed underneath joints 3, 4, then they are placed directly on this surface. Of course, piers can be erected, and the joints can be placed on top of the piers. Furthermore, there are joints which contact four floor surface units 1 and joints which contact two floor surface units 1. The details of joints 3, 4 are described later.

Referring to FIG. 3, a low wall 5 is arranged in a vertical position on top of floor surface units 1. Low wall 5 is arranged along the perimeter of the floor which is constructed from floor surface units 1. Buttresses 6 are installed at spaced intervals along the interior of the low walls. In this manner, an outdoor space surrounded by the floor and low wall 5 is created.

Figure 4:
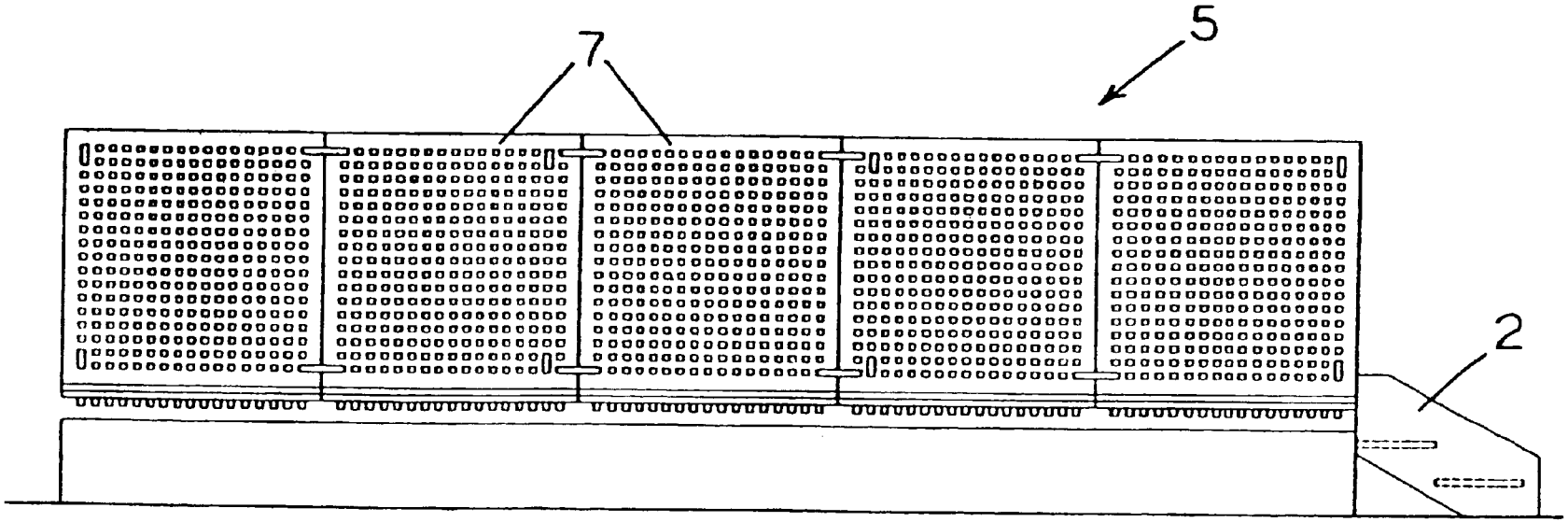
FIG. 4 is a view of FIG. 3 from the A arrow.
Figure 5:
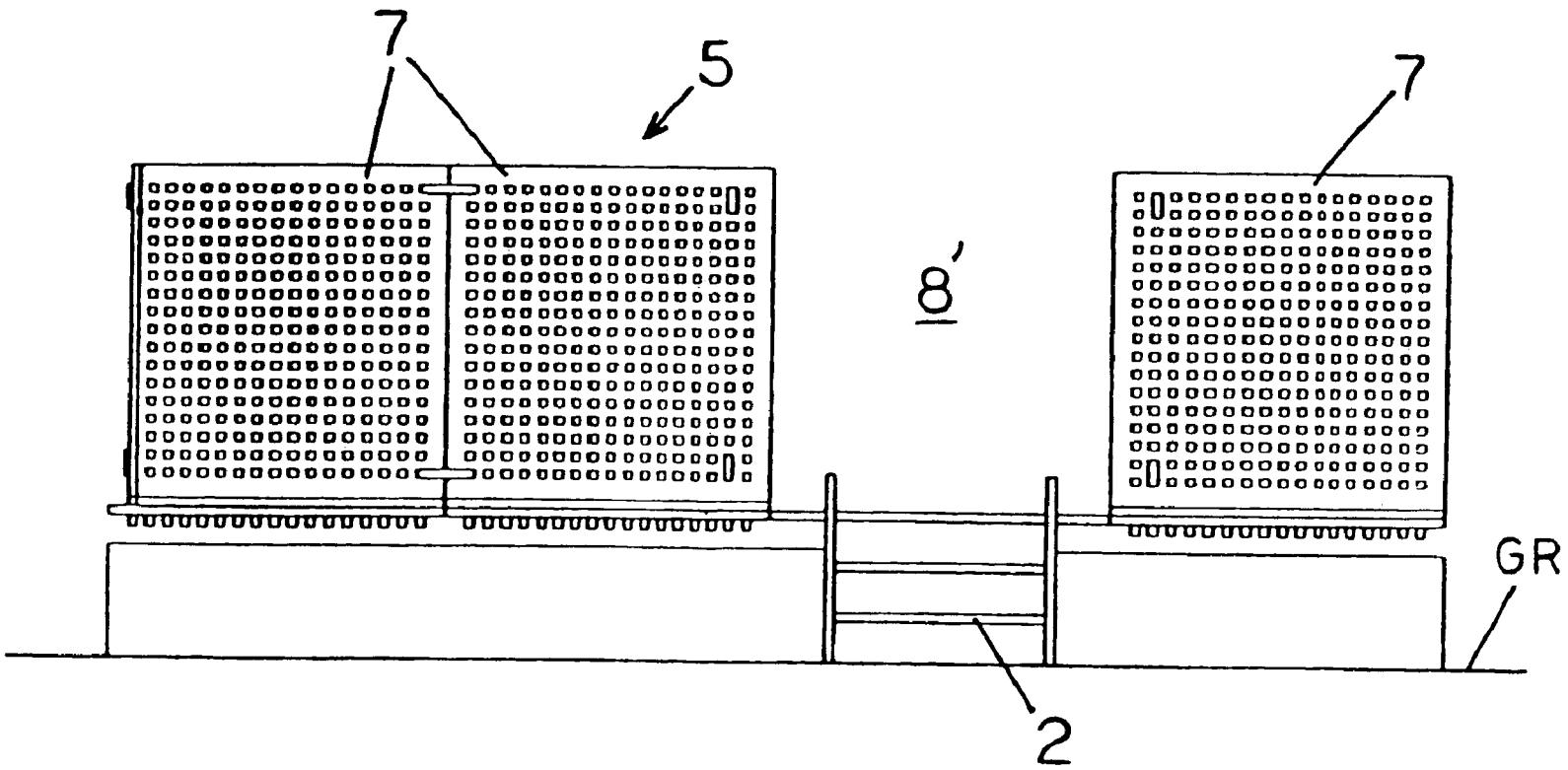
FIG. 5 is a view of FIG. 3 from the B arrow.

Referring to FIG. 4 and 5, low wall 5 is constructed by joining together a plurality of low wall units 7. Referring to FIG. 5, a portion of low wall unit 7 can be omitted, and an entrance for the above outdoor space can be created. Details of low wall unit 7 are described later.

Referring again to FIGS. 1 and 2, it is clear that this outdoor floor construction does not depend on sleepers or floor joists. As will be described later, by conducting a fitting together operation, the work is simple. Furthermore, after being built, the area of the floor can be easily changed by the addition or removal of floor surface units 1 or joints 3 or by alterations in their placement.

Figure 7:
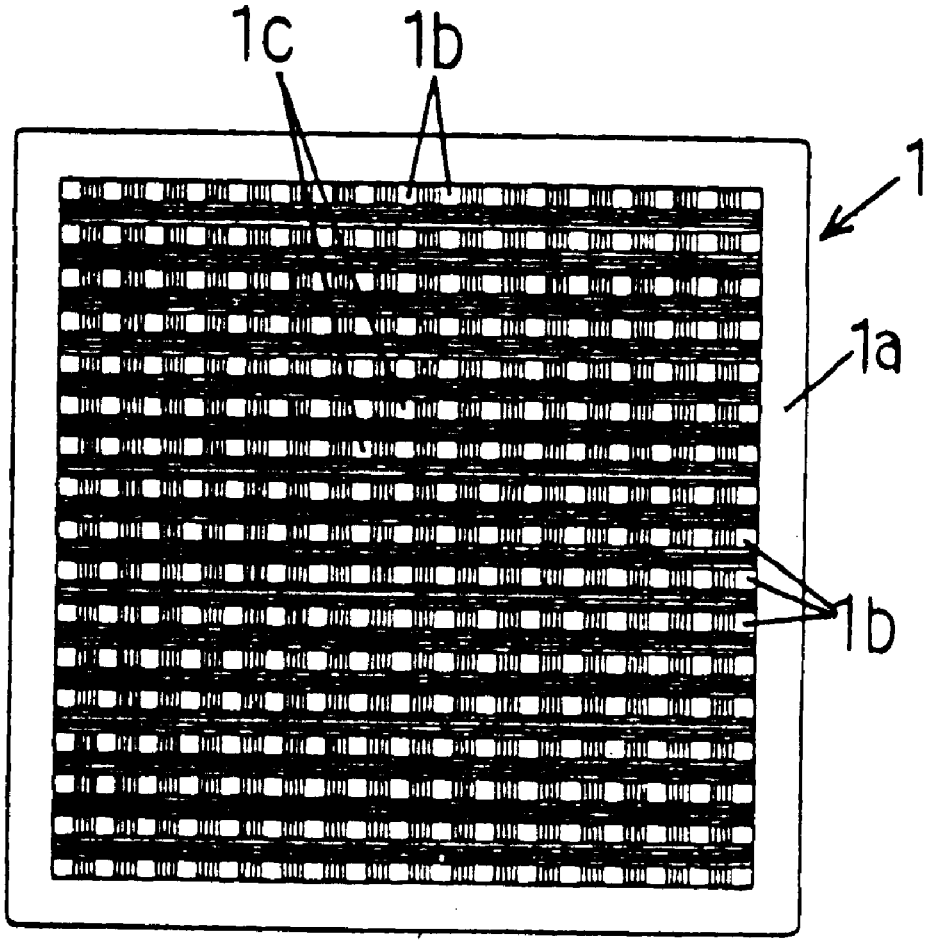
FIG. 7 is a plan view of the floor surface unit of an embodiment of the present invention.

In the present invention, floor surface unit 1 can be selected from the following two types. Referring to FIG. 7, one type has a square frame 1*a* and a lattice part which is centered inside frame 1*a*. There are a plurality of through holes 1*b* along the four edges of floor surface unit 1 (the places where it is circumscribed by frame 1*a*),. Furthermore, the part of the floor surface unit that is inside of through holes 1*b*, has similar through holes 1*c*. Through holes 1*b* and 1*c* pass perpendicularly through floor surface unit 1 in the thickness direction. In this type of floor surface unit, through holes 1*b* and 1*c* are formed over almost the entire surface of floor surface unit 1. Even if it is installed in a location with no roof and in an environment where it is exposed to rain water, water drainage is good, rotting is controlled, and the life of the floor is extended.

Figure 8A:
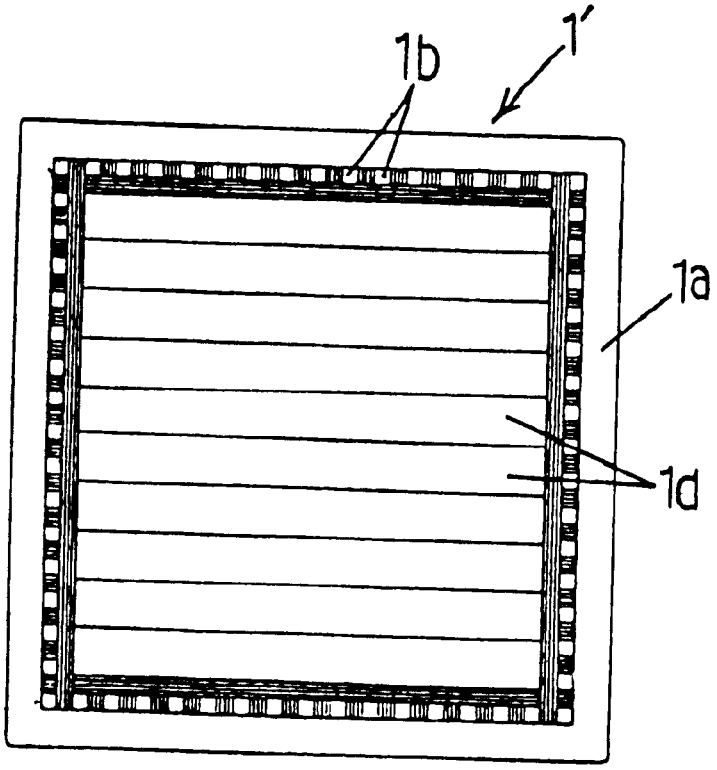
FIG. 8*a* is a plan view of the floor surface unit of an embodiment of the present invention.
Figure 8B:
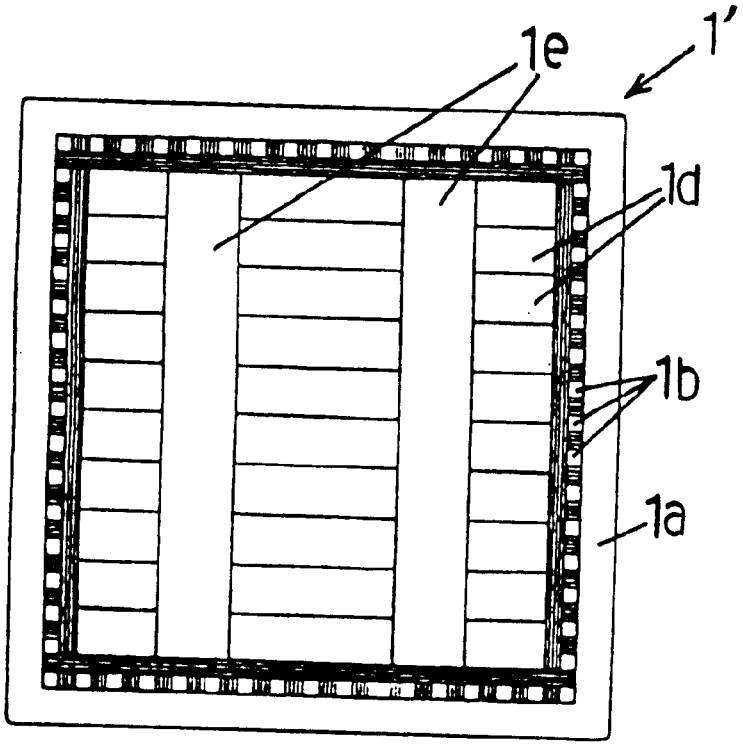
FIG. 8*b* is a bottom view of the floor surface unit of FIG. 8*a*.

Referring to FIG. 8, a second type of floor surface unit is depicted, that is similar to the floor surface unit 1 of FIG. 7. This second type of floor surface unit 1' also has a frame 1*a* and through holes 1*b* along its edge. However, with this type, the interior of the floor surface unit is made as flooring material. On the front side, parallel horizontal boards 1*d* can be seen. On the back side, longitudinal boards 1*e* support horizontal boards 1*d* from underneath. As a result, when this type of floor surface unit 1' is used, the floor has an outward appearance of being covered mostly by flooring. When tables or chairs are placed on the floor, if their legs are placed on top of horizontal boards 1*d*, they can be moved smoothly without catching on the through holes.

Referring to FIGS. 7, 8, in either type, through holes 1*b* are formed along the edges of either type of floor surface unit. As will be described later, these holes are for interlocking with the latching pieces of joints 3, 4, or for inserting the comb teeth piece of low wall 7.

Next, low wall unit 7 will be described. Two types are prepared: one for places other than the corners of low wall 5 (FIG. 9); and one for the corners (FIG. 10). First, referring to FIG. 9, the low wall 5 that is used for places other than the corners, members which are the same as floor surface unit 1 are erected vertically. A comb teeth piece 8 is fastened to a position on the bottom surface by using a dowel and glue together, for example. The teeth of comb teeth piece 8 are placed so that they project downwards. The pitch and size of teeth 9 are made to match that of through holes 1*b*.

Figure 9:
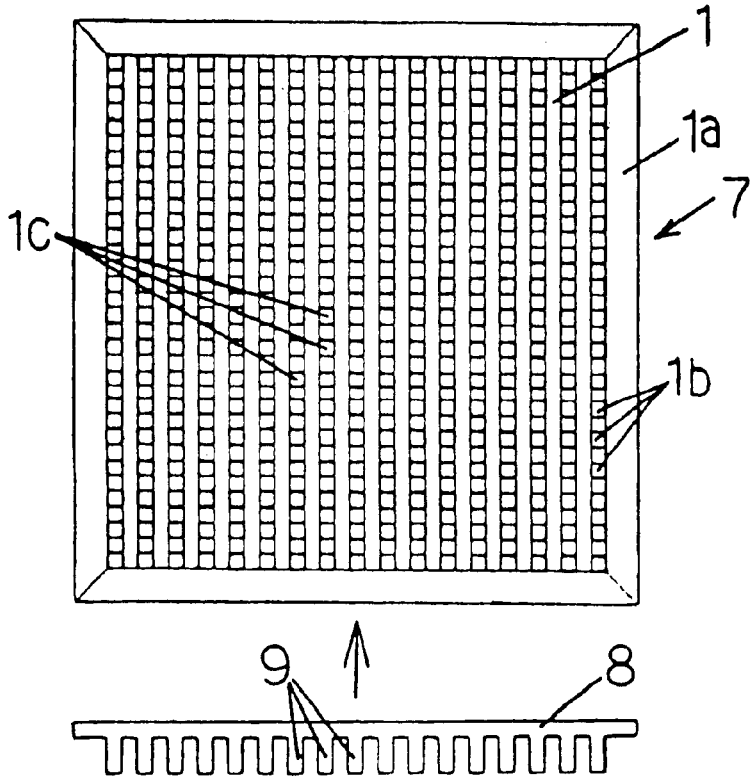
FIG. 9 is a plan view of a low wall unit of an embodiment of the present invention.
Figure 10:
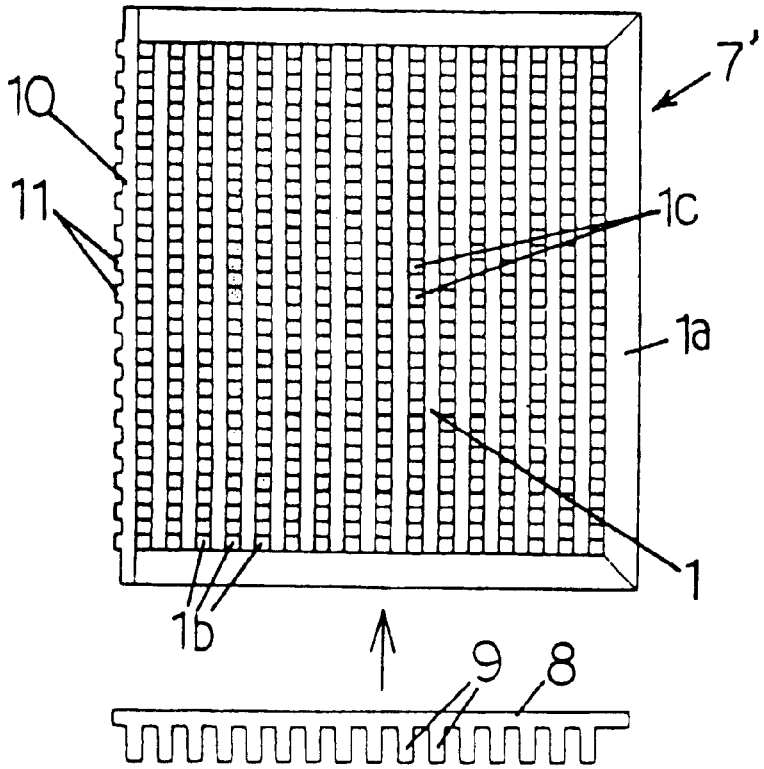
FIG. 10 is a plan view of a low wall unit of an embodiment of the present invention.

For the corners (FIG. 10), low wall unit 7' is almost the same as that of FIG. 9. However, one side of frame 1*a* is exchanged for a comb teeth edge 10. Again, the pitch and size of teeth 11 of comb teeth edge 10 matches that of through holes 1*b*, and the teeth project outwards.

Figure 11:
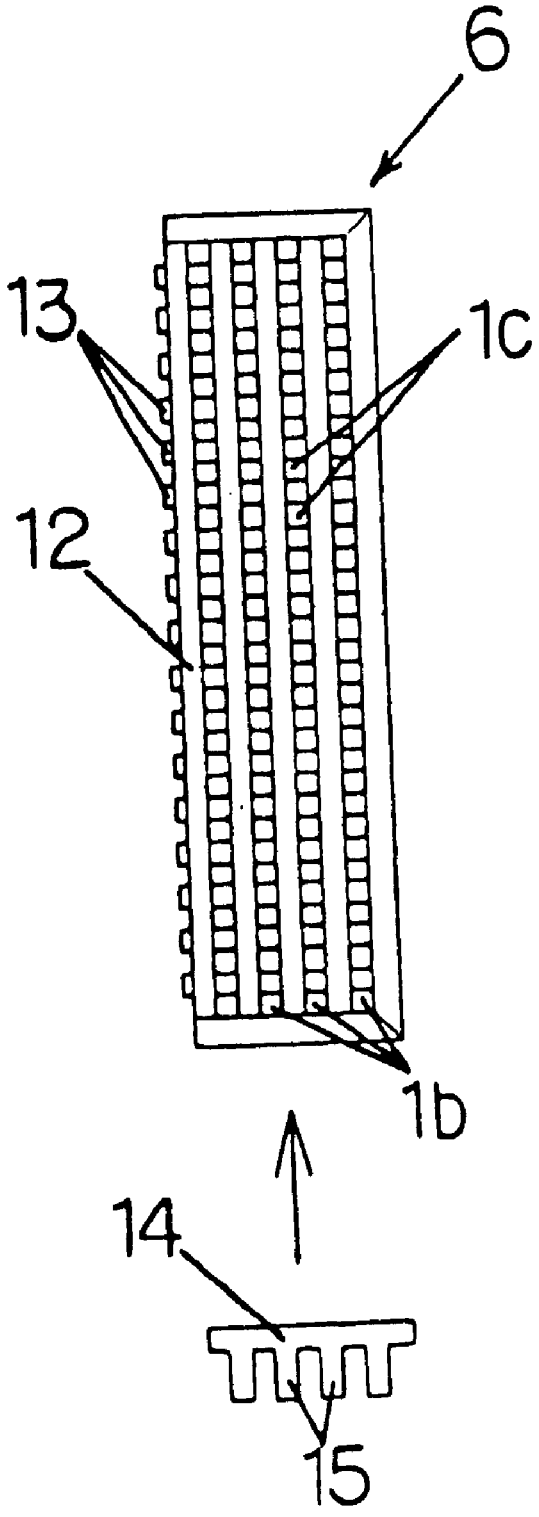
FIG. 11 is a plan view of a buttress for a low wall unit of the present invention.

Referring to FIG. 11, buttress 6 is a corner low wall unit 7' having a narrower width. In other words, buttress 6 also has a comb teeth edge 12 with outwardly facing teeth 13. A comb teeth piece 14 with downward facing teeth 15 is fastened to its bottom surface. The length of teeth 13 are less than half of the depth of through holes 1*b*.

Referring to FIGS. 9–11, through holes 1*c* may be present or absent in the interior portion the surface floor unit 1 or low wall 5. However, with this example, the sharing of parts and the uniformity in outside appearance was considered. For this reason, units having through holes 1*c* was selected.

Figure 12A:
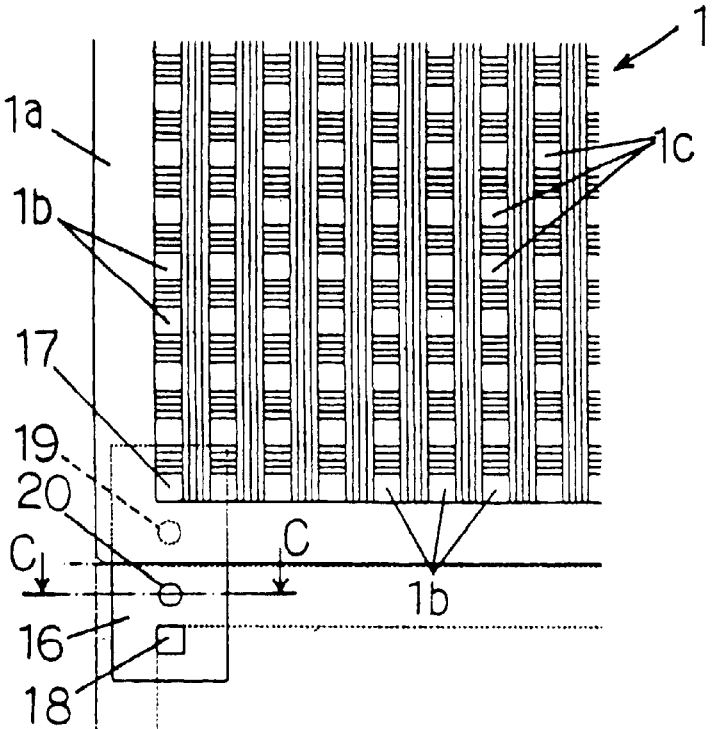
FIG. 12*a* is a plan view showing the joining together of two floor surface units of the present invention.
Figure 12B:
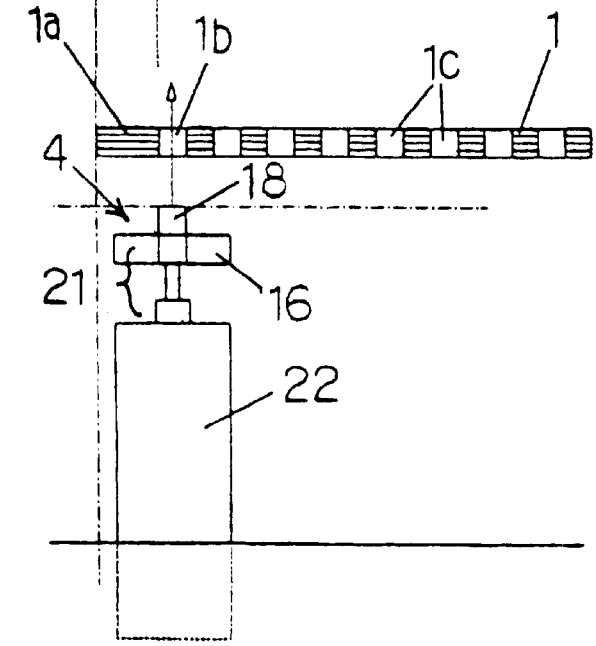
FIG. 12*b* is a cross-section showing the joining together of two floor surface units of the present invention.
Figure 13:
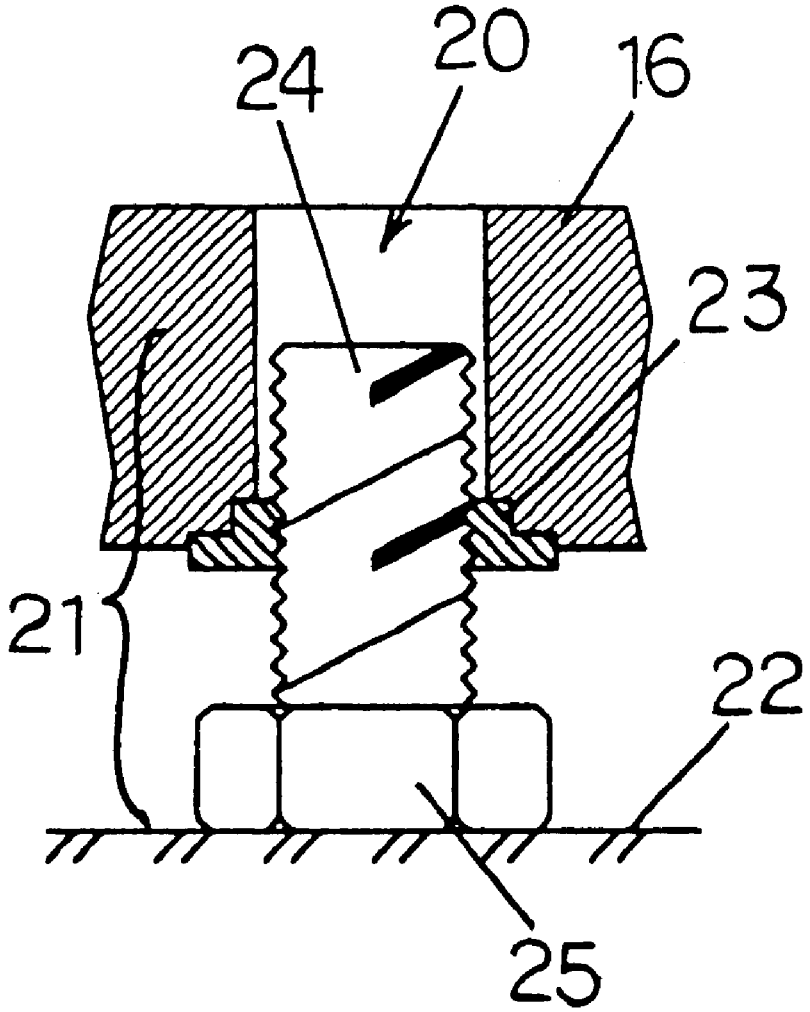
FIG. 13 is a cross-section of FIG. 12 along line C—C.
Figures 14A, 14B:
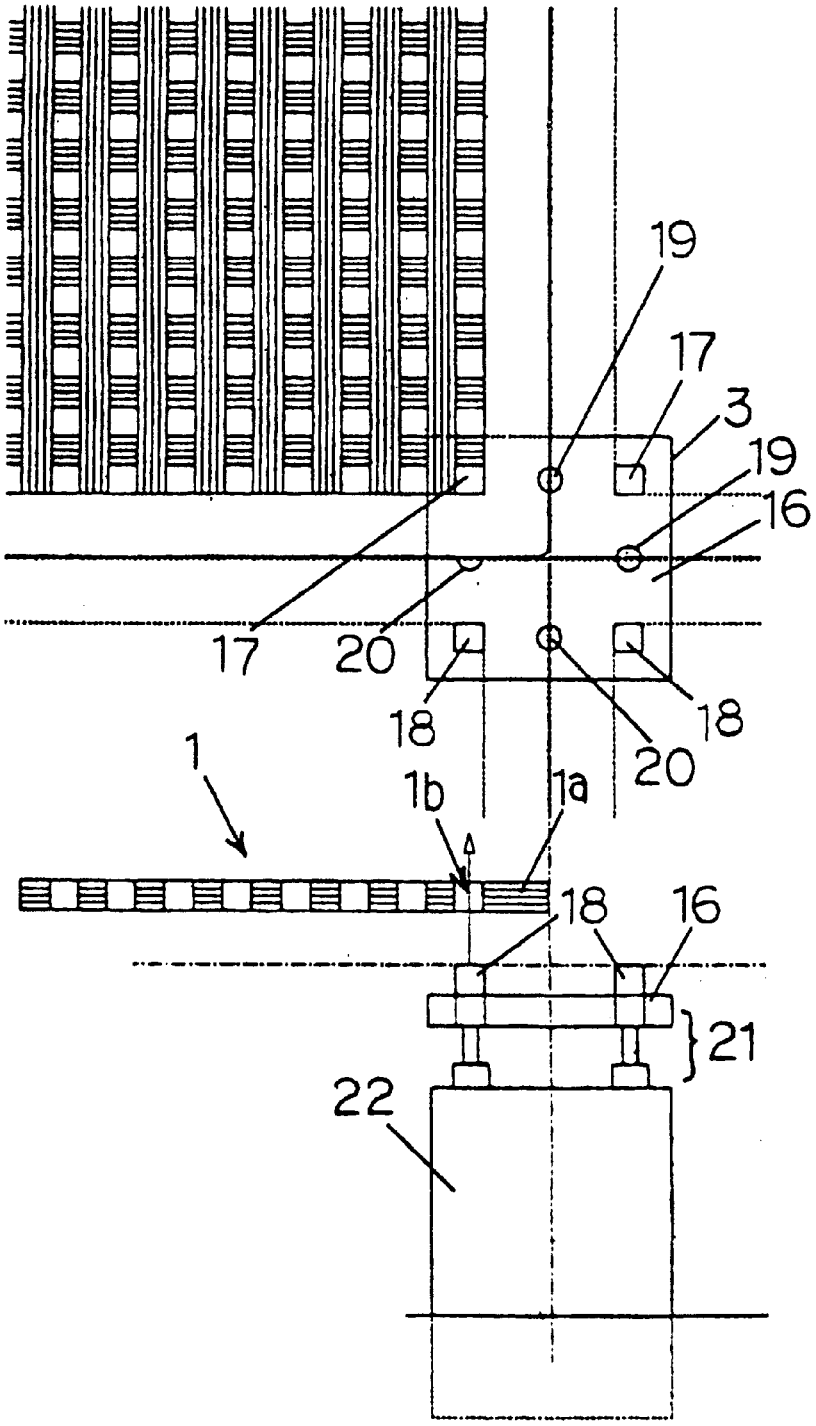
FIG. 14*a* is a plan view of the joining together of four floor surface units of the present invention.
FIG. 14*b* is a cross-section showing the joining together of four floor surface units.

Next, referring to FIGS. 12–14, the joining together of floor surface unit 1 and joints 3, 4 is described. First, referring to FIG. 12, at the edges of the floor, two adjacent floor surface units 1 are joined together by joint 4. Joint 4 comprises a board-like pedestal 16 and two latching pieces 17, 18 which are spaced uniformly apart with respect to the center line of pedestal 16. Latching pieces 17, 18 are formed that project upward from pedestal 16 and can be inserted into through holes 1*b*.

Furthermore, on pedestal 16, circular holes 19, 20 are located in places closer to the center line than latching pieces 17, 18. Circular holes 19, 20 penetrate through pedestal 16 in the thickness direction. An adjuster 21 is attached underneath circular hole 20. Adjuster 21 can adjust the height of the upper surface of pedestal 16 from foundation 22. Referring to FIG. 13, adjuster 21 can comprise: a female screw 23 which is inserted into the bottom part of circular hole 20; and a bolt 24 which screws into female screw 23. Bolt 24 is placed so that its head 25 is directed downwards.

The bolt head 25 is normally in contact with the top surface of foundation 22. By rotating the head 25, the height of female screw 23 with respect to the foundation 22 (the height of floor surface unit 1) can be changed. A driver groove can be carved on the end of bolt 24. A driver can be engaged with this driver groove so that bolt 24 can be rotated. When constructed in this manner, the height adjustment can be made from above, and the operation becomes easier.

Referring to FIG. 13, it is clear that even if a foundation 22 is not provided by striking the adjuster 21 into the ground, there is no impediment to adjusting the It floor surface unit height. Furthermore, when a foundation is formed from concrete, this surface can be used directly.

In this example, referring to FIG. 12*a,* latching pieces 17, 18 may be engaged with through holes 1*b* which are located at the edges and corners. Of course, instead of this, latching pieces 17, 18 can also be engaged with through holes 1*b* that are offset from the corner a few spaces.

Referring to FIG. 14, in the center portion of the floor, four floor surface units 1 are adjacent to each other. In this case, the set of latching pieces 17, 18 are placed in twice as many places as in FIG. 12, or in other words in four places. Furthermore, in order to insure that the pedestal 16 is horizontal, for every intersection (corner) of four floor surface units 1, circular holes 19, 20 and adjuster 21 may be placed in 4 places which are in point symmetry.

Figure 15:
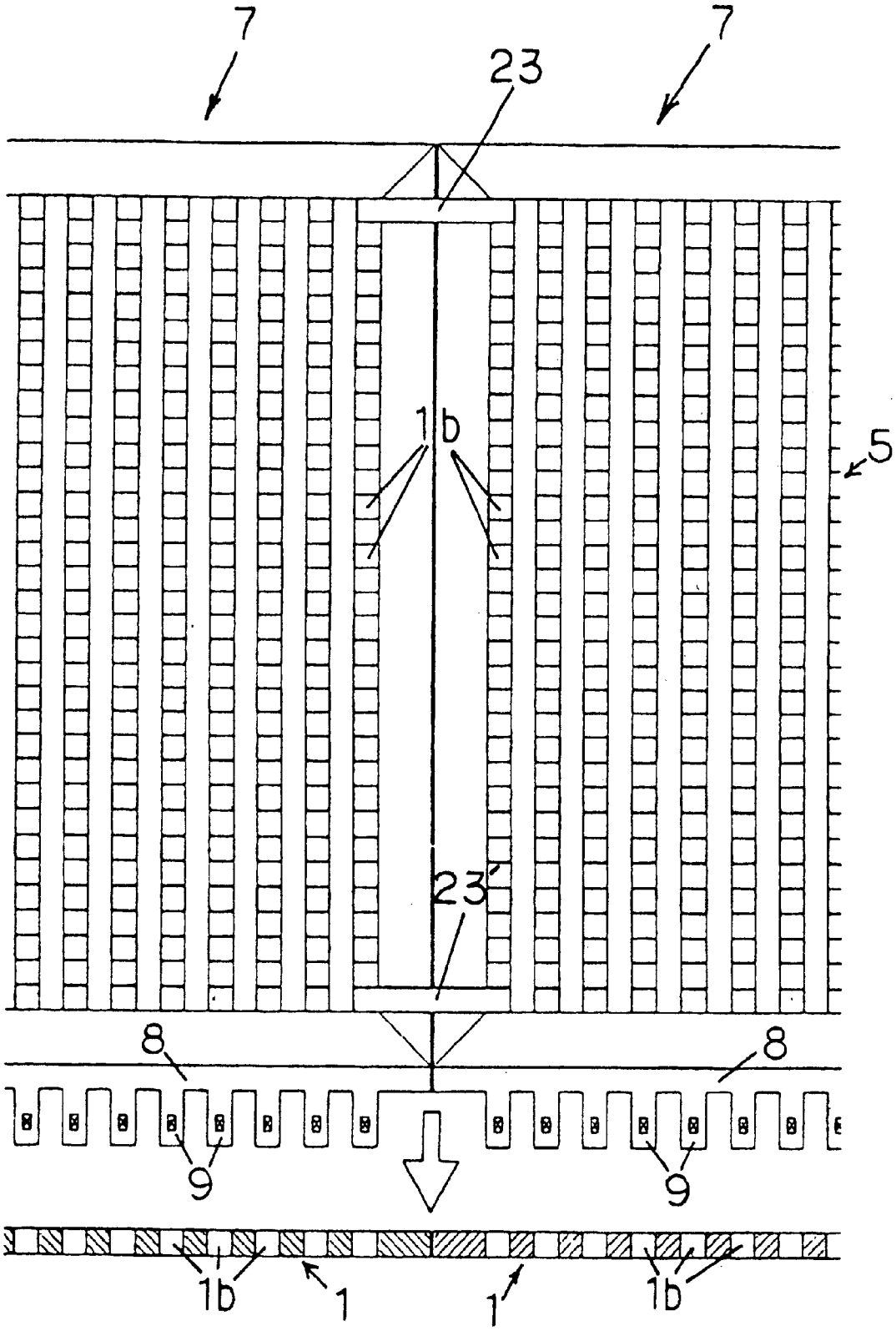
FIG. 15 is a front view of the joining together of low wall units.
Figure 16:
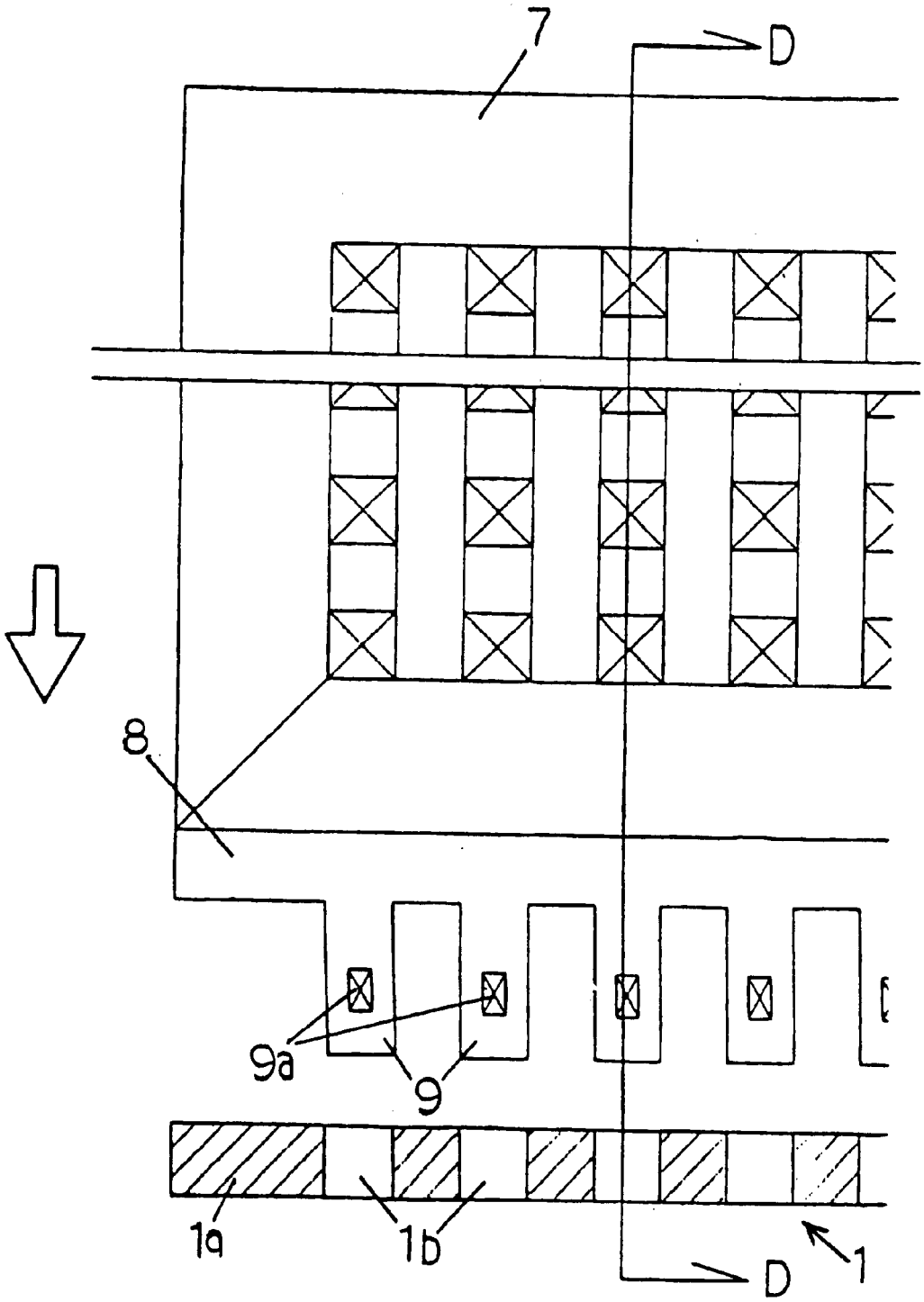
FIG. 16 is an expanded view of part of FIG. 15.
Figure 17:
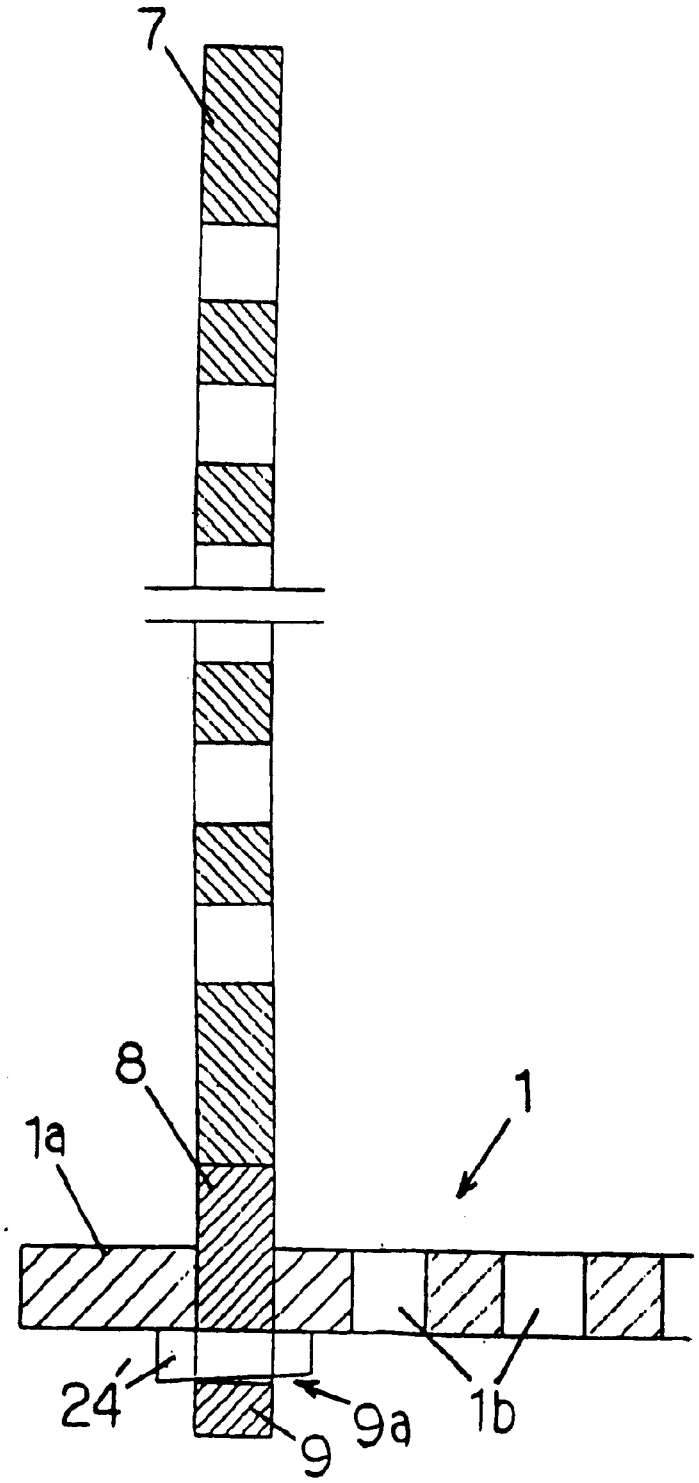
FIG. 17 is a cross-section of the joining together of a low wall unit.

Next, the joining together of low wall units 7 to each other and the joining of low wall 5 to floor surface units 1 will be described. Referring to FIG. 15, first, adjacent low wall units 7 are joined by a brace 23' which has a U-shaped cross-section. Referring to FIG. 16, next, each tooth 9 which projects downward from comb teeth piece 8 of low wall unit 7 is matched with and inserted into through holes 1*b* of floor surface unit 1. Referring to FIG. 17, a wedge 24' is pounded into and anchored to a wedge hole 9*a* which is located horizontally on tooth 9.

Figure 18:
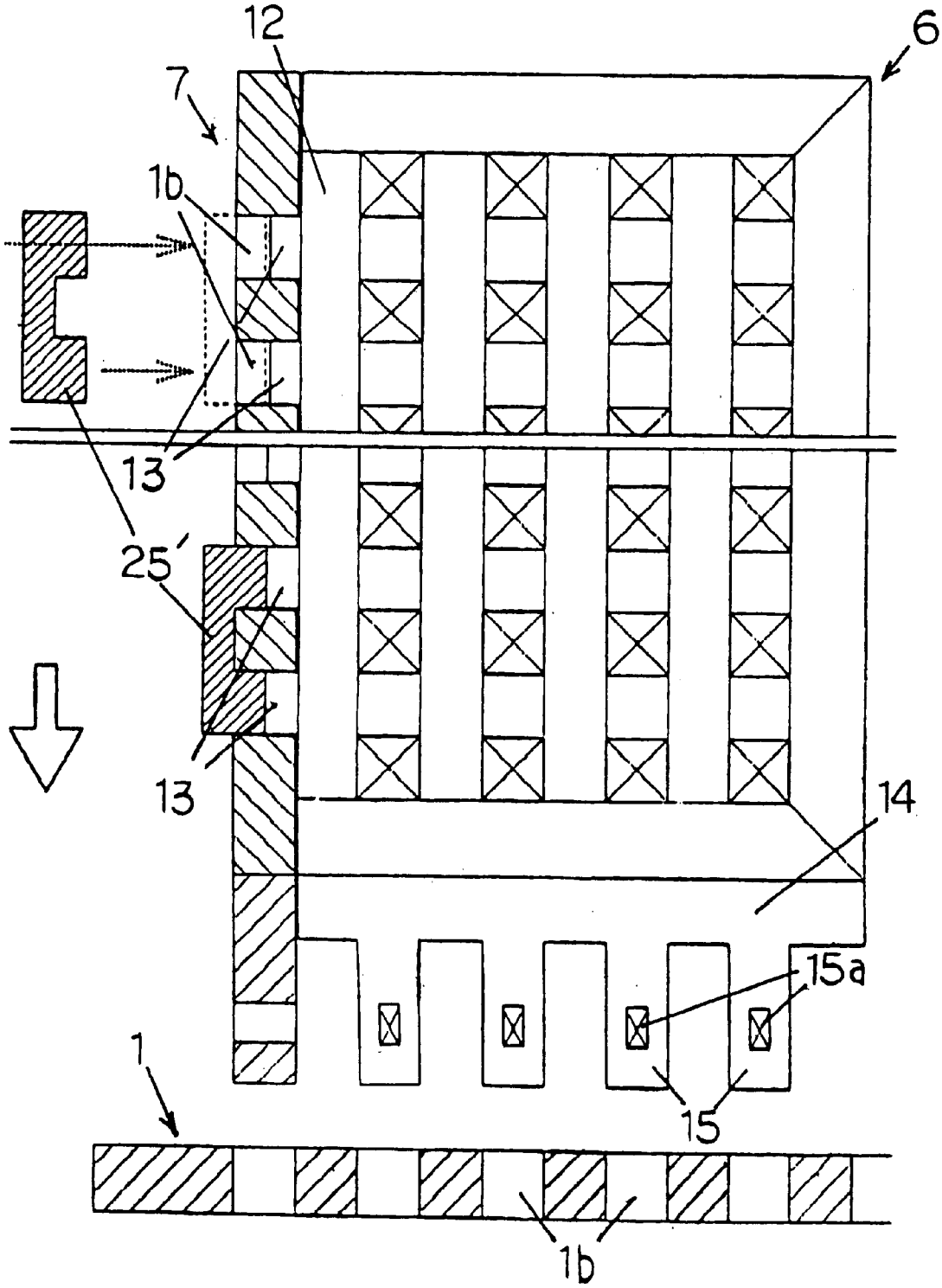
FIG. 18 is a front view of the joining of the buttress.

Finally, the joining of buttress 6 will be described. Referring to FIG. 18, first buttress 6 is joined to low wall unit 7. In other words, teeth 13 of buttress 6 are inserted into through holes 1*b* of low wall unit 7. A fastening piece 25' can be attached from the opposite side as needed. Furthermore, fastening piece 25' and teeth 13 can be further joined together by a vise. As described above, the length of teeth 13 is less than half the depth of through hole 1*b*. The length was made to be less than half the depth of through hole 1*b* in order to insure that there would be enough space for fastening piece 25' . Next, buttress 6 is joined to floor surface units 1 in the same way as with low wall units 7. In other words, the teeth 15 of buttress 6 are matched with and inserted into through holes 1*b*. A wedge is pounded into and anchored to wedge hole 15*a* of teeth 15.

The present invention is constructed as above. As a result, sleepers and joists can be omitted, and the construction is done easily. Floor surface units can be placed freely. The size and shape of the floor can be changed readily.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A floor construction claimed in combination with a wall, the floor construction comprising:

at least first and second floor surface units;

said first and second floor surface units being installable adjacent each other;

said first and second floor units being capable of assembly with edges abutting each other;

a first hole in said first floor surface unit and a second hole in said second floor surface unit;

at least one joint member having means for supporting said floor surface units;

said joint member being aligned below said first hole and said second hole;

said joint member having at least a first and second latching piece; and said first latching piece fitting into said first hole and said second latching piece fitting into said second hole thereby retaining said first and second floor surface units with respect to one another, said wall being formed from at least one wall unit;

said wall unit having holes along four edges and a means for attachment to other wall units and to an outer edge of said floor surface unit; and said wall being arranged in a vertical position along the outer edge of said floor construction.

2. A floor construction as described in claim 1, wherein:

said wall unit has at least first and second teeth projecting downward from its bottom surface; and means for securing said teeth fixedly into holes of said floor surface unit.

3. A floor construction as described in claim 2, wherein said teeth are fixedly secured into holes of said floor surface unit using wedges.

4. A floor construction claimed in combination with a wall, the floor construction comprising:

at least first and second floor surface units;

said first and second floor surface units being installable adjacent each other;

said first and second floor units being capable of assembly with edges abutting each other;

a first hole in said first floor surface unit and a second hole in said second floor surface unit;

at least one joint member having means for supporting said floor surface units;

said joint member being aligned below said first hole and said second hole;

said joint member having at least a first and second latching piece; and said first latching piece fitting into said first hole and said second latching piece fitting into said second hole thereby retaining said first and second floor surface units with respect to one another;

a wall formed from at least one wall unit;

said wall unit having holes along four edges and at least first and second teeth projected downward from its bottom surface;

said teeth fixedly secured into holes of said floor surface unit using wedges;

at least one buttress;

said buttress having at least first and second teeth projected downward from its bottom surface and being fixedly secured into said holes of said floor surface unit; and said buttress having at least first and second teeth projected outward from a vertical side being fixedly secured to said at least one wall unit and said floor surface unit.

5. A floor construction of claim 4, further comprising:

at least one fastening piece; and said at least one fastening piece being fixedly secured to two adjacent wall units along an edge where said adjacent wall units meet.

* * * * *